US007721982B2

(12) United States Patent
Schwelling et al.

(10) Patent No.: US 7,721,982 B2
(45) Date of Patent: May 25, 2010

(54) FILE SHREDDER WITH FEED UNIT

(76) Inventors: Hermann Schwelling, Hartmannweg 5, 88682 Salem (DE); Xu Ning, 801 Room 48 Block Tong Fu West 2, Chan Chen Fong Shan, Guang Dong (CN); Zichun Yin, 14# Huo Ju East Street, Mian Yang High Technology Developing Area, Si Chuan Province (CN)

( * ) Notice: Subject to any disclaimer, the term of this patent is extended or adjusted under 35 U.S.C. 154(b) by 0 days.

(21) Appl. No.: 12/012,777

(22) Filed: Feb. 5, 2008

(65) Prior Publication Data

US 2008/0210794 A1 Sep. 4, 2008

(30) Foreign Application Priority Data

Feb. 6, 2007 (CN) ..... 2007 2 0048277
Feb. 4, 2008 (DE) ..... 10 2008 009 236

(51) Int. Cl.
*B02B 7/02* (2006.01)
*B02C 23/00* (2006.01)

(52) U.S. Cl. ..... 241/100; 241/236; 241/81

(58) Field of Classification Search ..... 241/100, 241/236, 81
See application file for complete search history.

(56) References Cited

U.S. PATENT DOCUMENTS 4,842,205 A 6/1989 Araki et al.
4,846,413 A * 7/1989 Inoue ..... 241/236
4,873,811 A * 10/1989 Izumitani et al. ..... 53/139.1
4,893,759 A * 1/1990 Mizobata ..... 241/100
4,957,243 A * 9/1990 Kanagaki et al. ..... 241/34
5,318,228 A * 6/1994 Macas ..... 241/21
5,362,002 A * 11/1994 Tsai ..... 241/222
5,429,313 A * 7/1995 Schwelling ..... 241/36
7,284,715 B2 * 10/2007 Dziesinski et al. ..... 241/36

FOREIGN PATENT DOCUMENTS

DE 22 14 800 9/1973
DE 36 14 028 10/1987
DE 10 2006 028 828 12/2007

* cited by examiner

*Primary Examiner*—Bena Miller
(74) *Attorney, Agent, or Firm*—Collard & Roe, P.C.

(57) ABSTRACT

A file shredder has an integrated unit for automatic feed of sheets of paper or similar materials. An upper device part contains a cutting mechanism, at least one drive, and a control device. A feed shaft leads from the top of the upper device part, and a secondary channel leads from a chamber-like intake opening disposed on the side, to the cutting mechanism. A hinged lid pivotable about an axis is assigned to the chamber-like intake opening, and the upper device part sits on a lower device part. A barrier is disposed near the front, lower edge of the face surface of the hinged lid, and along this edge. The barrier rests on the top sheet of the stack of sheets laid into the chamber-like intake opening, and removes any objects still adhering to this sheet, particularly staples, when the sheet is drawn in toward the cutting mechanism.

14 Claims, 7 Drawing Sheets

Detail C

Detail C

Detail D

Detail C

FILE SHREDDER WITH FEED UNIT

CROSS REFERENCE TO RELATED APPLICATIONS

Figure 1:
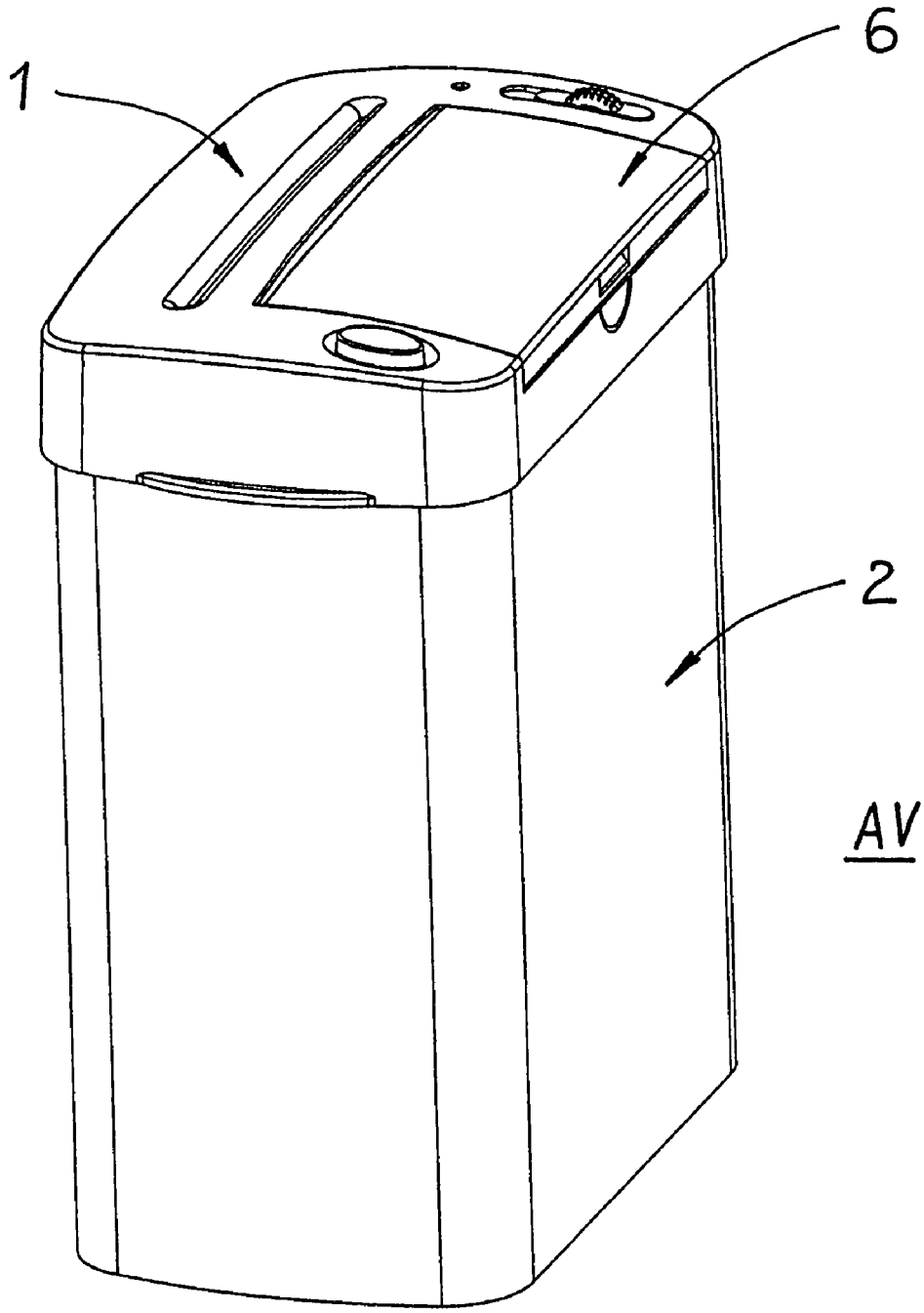

Applicants claim priority under 35 U.S.C. §119 of Chinese Application No. 2007 20 048 277.7 filed Feb. 6, 2007 and German Application No. 10 2008 009 236.3 filed Feb. 4, 2008.

TECHNICAL FIELD/AREA OF APPLICATION

The invention relates to a file shredder for material in sheet form, particularly paper and similar material, having an automatic paper intake for continuous intake of material in sheet form.

TECHNICAL BACKGROUND

In the state of the art, file shredders of the said construction, having an automatic paper intake for continuous intake of the material, are known in many different embodiments, e.g. a ripping machine according to U.S. Pat. No. 4,842,205, a paper shredder according to U.S. Pat. No. 4,893,759, a feed device for document shredders according to DE 36 14 028 C2, a shredding device according to DE 22 14 800 A, or a file shredder according to DE 10 2006 028 828 A1.

In the case of files held together with staples, if the staples have not been removed, too many sheets of paper can be drawn in during intake, for one thing, which cannot be shredded all at the same time by the device, and therefore cause jamming in the shaft or overloading of the cutting mechanism, with the consequence that the device, the file shredder, stops the shredding process; for another thing, a sheet of paper that has been drawn in can be pulled to the back by subsequent papers with staples, so that the file shredder either cannot draw the sheet of paper in correctly and therefore terminates the shredding process, or the sheet pulls in the sheets that are stapled together, thereby causing the paper to be jammed in the file shredder and causing the shredding process to be stopped.

Since, in a normal case, the sheets/papers to be shredded consist of stapled files, the staples usually have to be removed first, before the stack of sheets is laid into the file shredder for shredding.

On the one hand, removing the staples is time-consuming, but on the other hand, the stapled papers are not automatically shredded by every file shredder, particularly those in the lower price segment. Furthermore, persons who do not often operate the file shredder forget to remove the staples before placing the stack of papers on the paper deposit zone of the file shredder.

STATEMENT OF TASK

The task of the invention consists in creating a file shredder having a unit for automatic feed of material in sheet form, particularly paper or similar materials, in which any (foreign) objects/parts still adhering to the sheet being passed to the cutting mechanism are removed, whereby a continuous intake of the material to be shredded is guaranteed, and the effort in terms of equipment technology is slight.

THE INVENTION

The stated task is accomplished by means of a file shredder having an integrated unit for automatic feed of material in sheet form, particularly paper or similar materials, the upper part of which device contains at least one cutting mechanism, and in which a feed shaft leads from the top of the upper part of the device to the cutting mechanism, and a secondary channel leads from a chamber-like intake opening disposed on the side of the device to the cutting mechanism, whereby the chamber-like intake opening is an integral part of the integrated unit for automatic feed. In a novel embodiment, it is now provided, in the case of such a file shredder, that the integrated unit for automatic feed has means for laying on a stack of material in sheet form, means for removing the material sheet by sheet, and for transport with regard to a continuous intake, and furthermore means with which any objects still adhering to the sheet being passed to the cutting mechanism, particularly staples, paper clips, and the like, are removed during intake of the sheet, before it reaches the channel directed toward the cutting mechanism.

In advantageous manner, this task is accomplished by means of a file shredder having the characteristics of claim 1. In the case of this file shredder, with an integrated unit for automatic feed of material in sheet form, particularly paper or similar materials, a cutting mechanism, at least one drive, and a control device are provided in the upper part of this device. From the top, a feed shaft leads to the cutting mechanism, and from a chamber-like intake opening disposed on the side, a secondary channel leads to the cutting mechanism. The chamber-like intake opening has a hinged lid that can pivot about an axis assigned to it.

According to the invention, a barrier is disposed in the region of the front, lower edge of the side of the hinged lid, and along the same.

If material in sheet form is laid into the chamber-like intake opening, the barrier rests on the upper sheet of the stack of sheets, so that when the latter—the top sheet—is drawn in toward the cutting mechanism, any objects still adhering to this sheet, particularly staples, are removed/torn off.

The invention closes the gap in the existing, known technology, so that even material that still has staples adhering to it can be laid onto the paper deposit zone, the carrier, while any objects still adhering to the sheet of paper are reliably removed during continuous intake, before the sheet reaches the channel disposed ahead of the cutting mechanism of the file shredder, in which feed occurs. With this improved integrated unit for automatic feed, a possibility is therefore created that interruptions in operation of the cutting mechanism or in feed channels directed toward the cutting mechanism should no longer occur, particularly in the case of file shredders in the lower price segment. Furthermore, the size of the safety range can therefore be reduced at the predetermined motor power, and this has a positive effect on the equipment price.

This file shredder, whose unit for automatic feed passes individual sheets to the cutting mechanism in a continuous intake from a stack of material in sheet form, has a simple structure.

The upper part of the device sits on a lower part of the device, preferably on a paper collection container, but it can also be disposed above a sub-structure in the form of a cabinet.

The dependent claims 2 to 14 disclose advantageous embodiment variants of the invention.

According to the basic embodiment of the invention, the barrier is preferably a metal strip that is disposed in the region of the side of the hinged lid, on or in its underside, whereby the side directed upward from a front edge of an underside of the metal strip is essentially at a right angle to the underside.

According to another, further improved embodiment variant, at least one heavy body in the form of a metal piece is disposed in the front region of the hinged lid, close to the side, and far removed from its pivot axis, preferably at the underside of the hinged lid, thereby making it possible to define and, optionally, to determine the resting weight and the force with regard to adhering objects, depending on the case of use and field of use of the file shredder.

In another embodiment, the heavy body is formed from multiple metal pieces attached at a distance from one another, which are also preferably disposed on the underside of the hinged lid.

According to an alternative embodiment of putting weight on the front region of the hinged lid, a force storage unit, which is preferably formed from one or more springs, acts on the hinged lid, in such a manner that the latter rests on the top sheet of the stack of sheets that has been laid in, with its barrier, under pressure. This can be a pressure spring or a tension spring, depending on the embodiment and position of its arrangement in or on the upper part of the file shredder, whereby in place of a spring, a body of elastic material can also be used.

In order to further improve the effect of the barrier, the metal strip, with regard to the adhering object to be removed and retained, according to another embodiment variant, the side directed upward from a front edge of the underside of a second metal strip is at an acute angle relative to the underside; however, this front face surface that is directed upward can also be concave, and is a third embodiment of the metal strip.

According to another embodiment variant, the metal strip is magnetic, at least in sections, so that metal objects that are torn off collected on it.

Furthermore, in its second, i.e. third embodiment, the metal strip is shaped in jagged shape at its front edge; multiple notches disposed next to one another form teeth that are spaced apart. The tip of each tooth is rounded, in order to reduce the risk of injury.

Before the start of shredding, a stack of material in sheet form is laid onto the paper deposit zone of the unit, for automatic feed; then the lid is closed, so that the free end, the front side of the hinged lid, lies on the top sheet of the stack. The stack of paper must be laid down in such a manner that the corners or edge regions of the sheets that are laid down, which have the staples or paper clips, are situated in front of the closed hinged lid.

The file shredder is started, continuous intake begins. The paper intake of the integrated unit for automatic feed draws individual sheets of the stack that has been laid down, starting from the top. If a sheet of paper that is drawn in is stapled together with other sheets, the other sheets (papers) are at first also drawn in the direction of the feeding opening, the secondary channel, during intake. When they reach the front side of the hinged lid, the metal strip disposed on the hinged lid retains staples and the like, so that the additional sheets are prevented from being drawn in, while the top sheet of paper that was drawn in continues to be transported forward by the drawing force of the paper intake. In that moment, the sheet of paper that was drawn in is separated from the other sheets that are stapled together, and automatic separation of the sheets stapled together takes place; the sheets released by the staple fall back down onto the carrier/paper deposit zone, and are drawn in, one after the other. The aforementioned work process repeats as soon as a top sheet of stapled sheets is drawn in.

The sheet of paper, now separate from the other sheets, is completely drawn in, passed to the cutting mechanism by way of the secondary channel, and shredded there.

As explained above, the present invention has a very simple structure, and works in safe and reliable, uncomplicated and fast manner.

EXEMPLARY EMBODIMENTS

Figure 2:
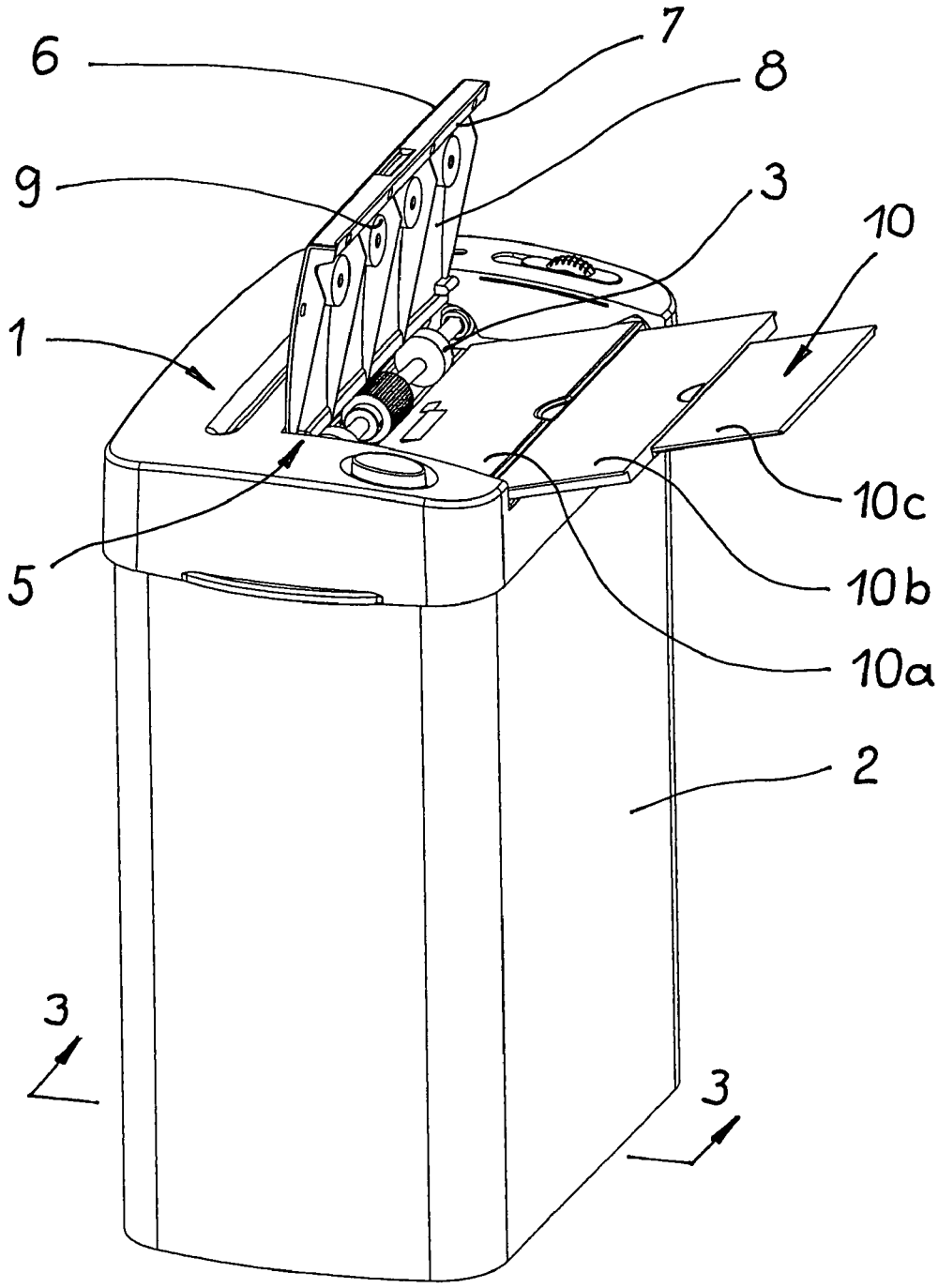
Figure 3:
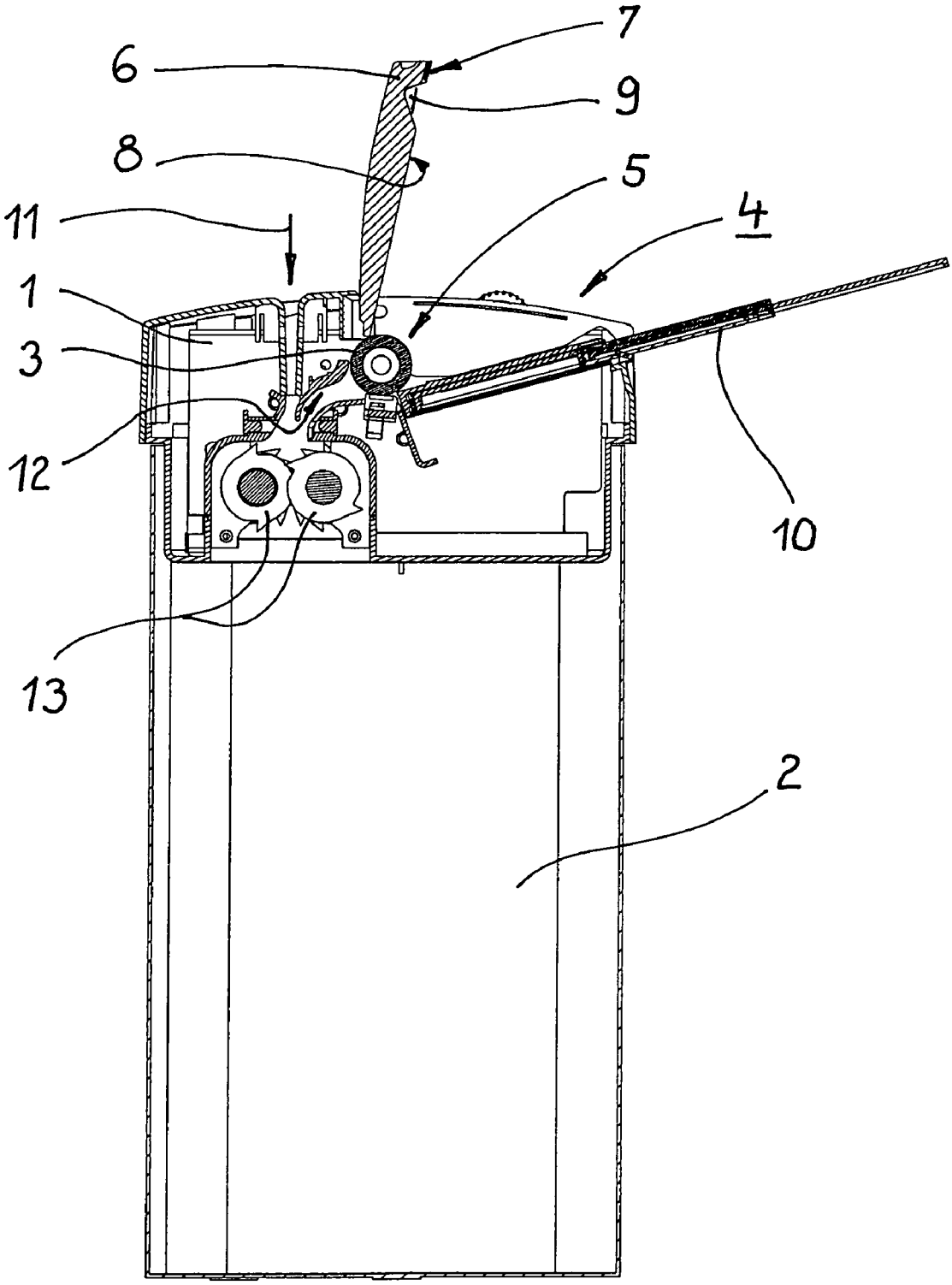
Figure 4:
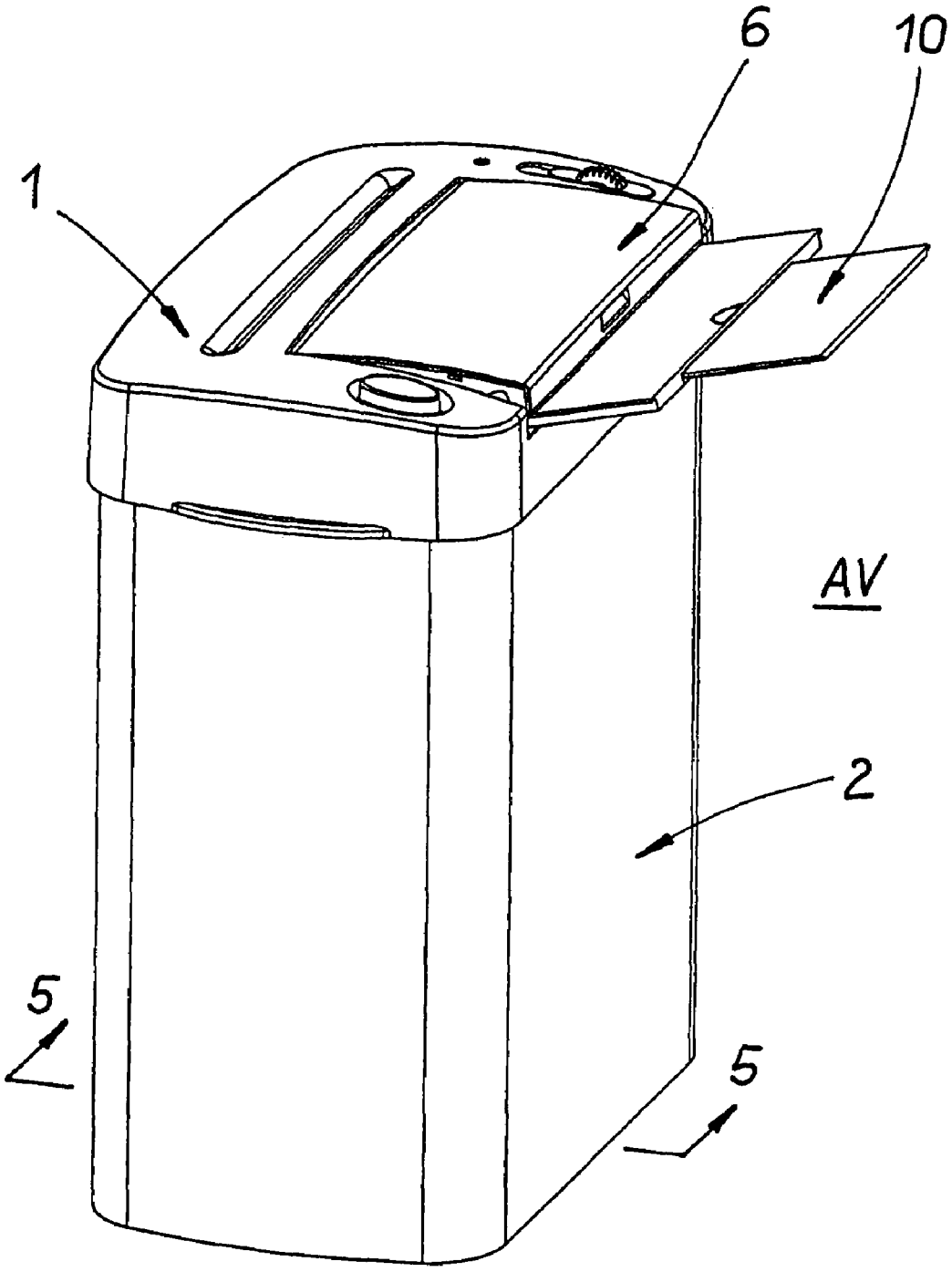
Figure 5:
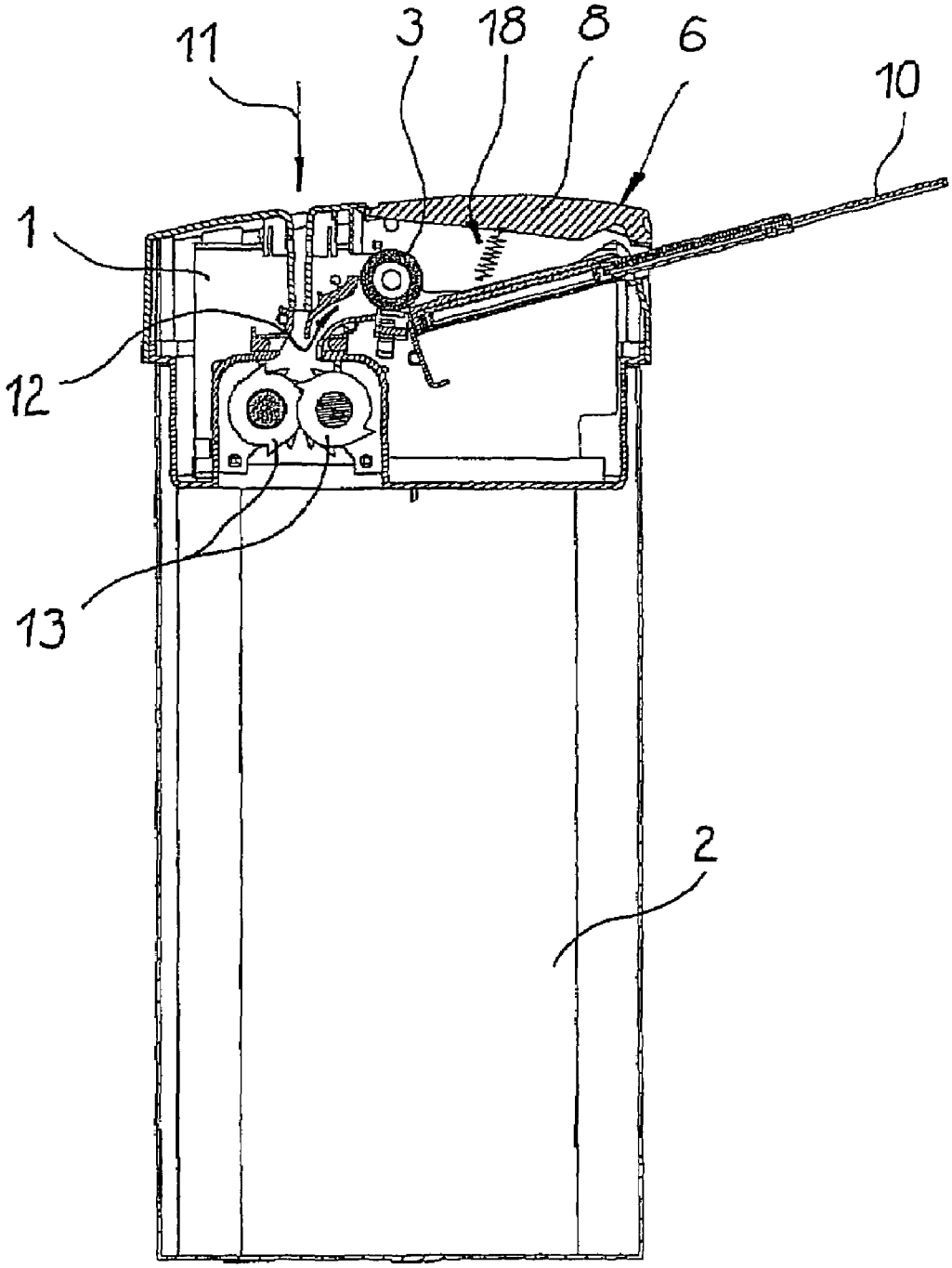
Figure 6:
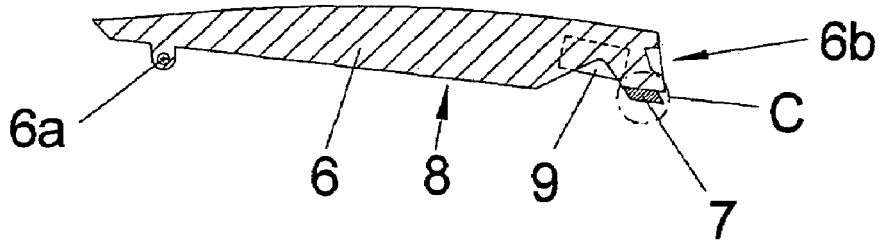
Figure 6A:
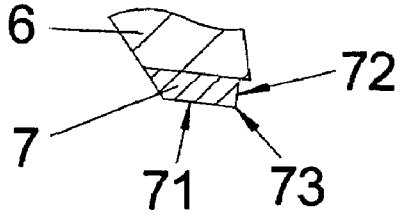
Figure 6D:
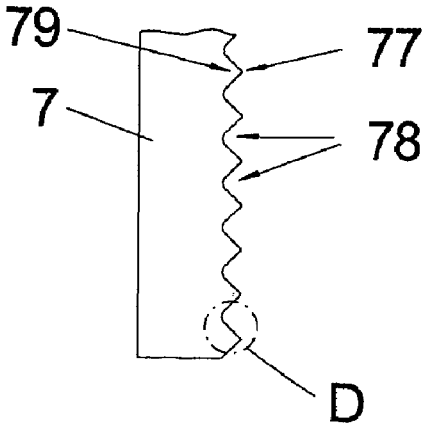
Figure 6B:
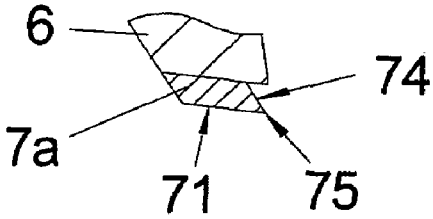
Figure 6E:
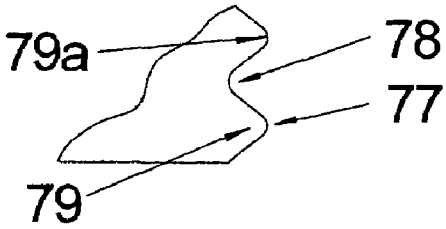

In the following description part, further details, characteristics, and advantages of the invention will be stated and explained in greater detail, and furthermore they can be derived in connection with the description of the exemplary embodiments of the invention shown schematically in the drawings. These show:

FIG. 1: A perspective view of the new file shredder with integrated unit for automatic feed of material in sheet form;

FIG. 2: the file shredder according to FIG. 1 with the unit for automatic feed standing open;

FIG. 3: the file shredder according to FIG. 2 from the side and in cross-section;

FIG. 4: the file shredder according to FIGS. 1 to 3 with an extended paper deposit zone;

FIG. 5: a side view of the representation according to FIG. 4, in cross-section;

FIGS. 6 to 6*e*: details of the lid of the unit for automatic feed; and

Figure 7:
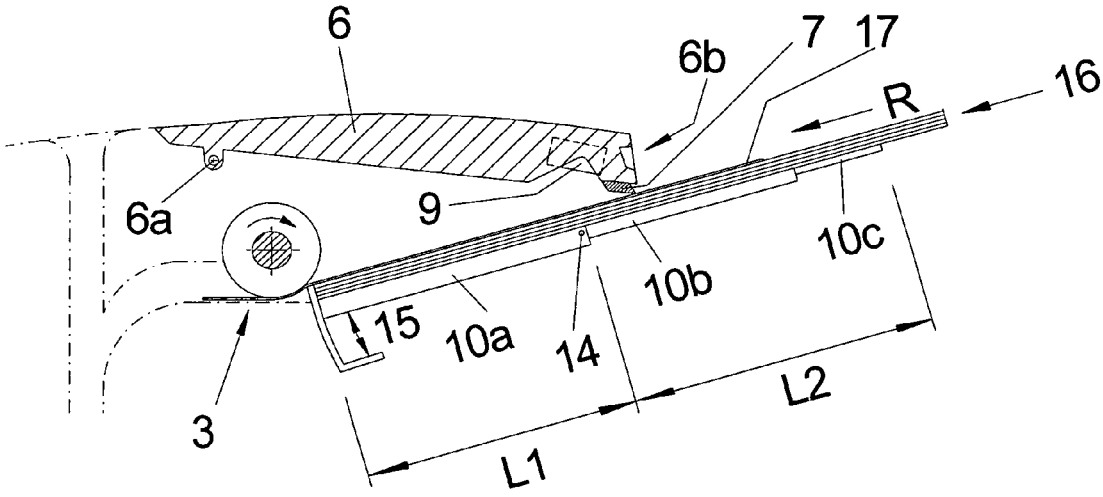

FIG. 7: a fundamental diagram relating to removal of staples from the material drawn in.

FIG. 1 shows a perspective view of the new file shredder "AV" with integrated unit for automatic feed 4 of material 16, 17 in sheet form. Further views of the file shredder "AV" in various operating states are shown schematically in the other figures, particularly FIGS. 2 to 5 and 7. The file shredder "AV" consists of an upper device part 1 and a lower device part 2, which is a paper collection container here. The upper device part 1 is set onto the lower device part 2 in removable manner. A unit for automatic feed of material in sheet form is integrated into the upper device part 1, see FIG. 2. For this purpose, a recess is made in the upper device part 1, forming an intake opening 5, from the top of the upper device part 1. Inward with regard to the body, a paper intake 3, preferably a driven shaft having at least one driver roller, is provided in the end region of the intake opening 5, see also FIG. 3 in this regard. After the paper intake 3, a secondary channel 12 follows. This secondary channel 12 ends above the cutting rollers of the cutting mechanism 13, just like a feed shaft 11 that proceeds from the top of the upper device part 1.

The intake opening 5 and the paper intake 3 of the integrated unit for automatic feed 4 are covered by a hinged lid 6. The carrier 10 for laying down a stack of material 16 in sheet form is also part of this unit 4.

The carrier 10 consists of multiple parts, the first plate 10*a*, the second plate 10*b*, and the third plate 10*c*. The second plate 10*b* is disposed so that it can hinge on or be pushed into the first plate 10*a*, and the third plate 10*c* so that it can hinge on or be pushed into the second plate 10*b*. When it is not in use, the carrier 10 can be pushed or folded into itself. In this state, it lies completely under the hinged lid 6 in the intake shaft 5. There, it is stored until its next use.

The hinged lid 6, see FIGS. 2, 3, and 6, is held in hinge-like manner to the side of the intake opening 5, with its pivot axis 6*a*, in other words it can be pivoted.

A metal strip 7 is mounted on the front of the lid 6, in the lower region. Of course, the metal strip 7 can be replaced with other materials, which withstand the stress demands, as long as the front of the strip has sufficient strength and demonstrates little wear. The shape of the strip 7 for retaining the staples can also change, as will be explained further below.

For sufficiently strong contact of the hinged lid 6 on the top sheet 17 of the stack of material 16 in sheet form that has been laid in, metal pieces 9, here four pieces, are attached on its underside 8, at a distance from one another.

These metal pieces 9 can, of course, also be replaced with other heavy bodies, or by means of a force storage unit, preferably one or more springs 18, see FIG. 5 in this regard.

The method of function and effect of the invention is illustrated in FIG. 7. Material in sheet form that is to be shredded is laid onto the carrier 10*a*, 10*b*, 10*c*, and positioned in the intake opening 5 in such a manner that the top sheet 17 of the stack of material 16 in sheet form rests against the paper intake 3, the driven shaft with driver roller. The hinged lid 6 of the integrated unit for automatic feed 4 is in the closed position. The barrier provided at the bottom on the face surface 6*b* of the hinged lid 6, the metal strip 7, lies on the top sheet 17 with its front edge, which is directed outward. One sheet 17 after another sheet 17 is passed to the cutting mechanism through the secondary channel 12, from the stack 16, using the paper intake 3, the driver roller or rollers. The intake direction is marked with the reference symbol "R" here.

So that the top sheet 17 always rests against the paper intake 3, the carrier 10 is mounted to pivot on a hinge axis 14. In this embodiment, it is provided that when the carrier 10 is pulled out, in other words when its second plate 10*b* is aligned in series with the first plate 10*a*, and the third plate 10*c* is aligned in series with the second plate 10*b*, its total length is divided into two partial regions, the sections L1 and L2. In this connection, it is provided that the outer section L2 that projects out of the body of the file shredder is larger than the inner section L1. Thus, the weight of the section L1 of the carrier 10 that essentially lies within the intake opening 5 is always smaller than the weight of the section L2 of the carrier 10 disposed outside of the body, so that the front face side of the carrier 10, which lies toward the paper intake 3, is always forced in the direction of the driver rollers of the paper intake 3. The pivoting movement of the carrier 10 is indicated with the double arrow 15 in FIG. 7. At the same time, a stop is provided to limit the pivot range of the carrier 10, which stop is shown as a bracket in the case of the double arrow 15 in FIG. 7.

In the case of this embodiment, it is not necessary for the carrier 10 to be supported from below, here in the region of the double arrow 15, by a force storage unit, particularly a pressure spring. When paper is placed onto the carrier 10, and when the hinged lid 6, which engages in the region of the section L2 of the carrier 10 with its weight, next to the hinge axis 14, is closed, there is a positive influence on the said weight or force distribution at the sections L1 and L2, with regard to reliable contact of the material against the paper intake 3.

Details of the barrier, which is preferably a metal strip 7, are shown in FIGS. 6 to 6*e*. In FIG. 6, the hinged lid 6 shown in FIG. 5 is shown by itself. Directed to one end, a pivot axis 6*a* is provided, with which the hinged lid 6 can be pivoted from an open position, see FIG. 3, into a closed position, see FIG. 5, in the region of the intake opening 5 on the file shredder "AV." At the other end, on its face surface 6*b* that is directed outward, as already mentioned above, a metal strip 7 is disposed, from its underside 8 out, see FIG. 2; this strip preferably reaches from the left side to the right side of the hinged lid 6.

FIG. 6*a* shows the detail C from FIG. 6 in greater detail. Here, the metal strip 7 is shown in its basic embodiment. The face side 72 that is directed upward from the face edge 73 of its underside 71 is at a right angle to the underside 71 here.

FIG. 6*b* shows a second embodiment of the metal strip. In the case of this metal strip 7*a*, the face side 74 is inclined inward toward the body, so that an acute angle is formed between it and the underside 71, with regard to its face edge 75.

Figure 6C:
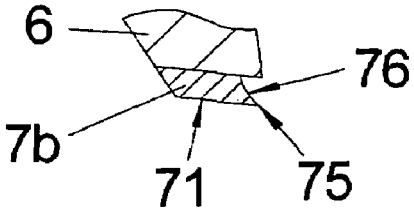

FIG. 6*c* shows a third embodiment of the metal strip. In the case of this metal strip 7*b*, the face side 76 that is directed upward from the face edge 75 is structured to be concave; preferably, the angle between it and the underside 71 is also acute.

FIG. 6*d* shows another embodiment of a metal strip according to the second 7*a* or the third 7*b* embodiment. In the case of this further embodiment variant, multiple notches 78 are provided from its face edge 77 out, inward toward the body 7*a* or 7*b*, respectively, so that multiple points 79 are formed. The free end 79*a* of the points 79, see Detail D in FIG. 6*e*, is preferably rounded, so that here, no knife-sharp tips are present, which could lead to injury of the operator's hand in case of improper operation of the hinged lid 6.

This further embodiment variant of the barrier, the metal strip 7*a*, 7*b*, in particular, bring about the result that any foreign bodies still adhering to the sheet that is drawn in, such as staples, paper clips, etc., are grasped even more securely and retained. It is also advantageous that the metal strip 7, 7*a*, or 7*b* is magnetic, at least in partial regions. In this way, parts removed/ripped from the sheet that is drawn in are held, at the same time, and do not drop onto the floor next to the file shredder, in uncontrolled manner.

While the drawing characteristics identified above showed multiple preferred embodiments, other embodiments according to the invention, as mentioned in the discussion, are also being considered. This disclosure offers illustrative embodiments according to the invention as examples and not as restrictions. A person skilled in the art can think up numerous other modifications and embodiments that fall within the framework and the spirit of the principles according to the invention.

Reference Symbol List

| | |
|---|---|
| 1 | upper device part |
| 2 | lower device part |
| 3 | paper intake (driven shaft with driver rollers) |
| 4 | feed unit (unit for automatic feed) |
| 5 | intake opening (opening in item 1, in front of item 3) |
| 6 | hinged lid |
| 6a | pivot axis (for item 6) |
| 6b | face surface (of item 6) |
| 7 | metal strip |
| 71 | underside |
| 72 | face side |
| 73 | face edge |
| 7a | metal strip (second embodiment) |
| 71 | underside |
| 74 | face side |
| 75 | face edge |
| 7b | metal strip (third embodiment) |
| 71 | underside |
| 75 | face edge |
| 76 | face side |
| 77 | face edge |
| 78 | notches |
| 79 | points |
| 79a | free ends (of item 79) |
| 8 | underside (of item 6) |
| 9 | metal pieces (on item 8) |
| 10 | carrier (paper deposit zone) [paper slide] |
| 10a | first plate |

-continued

| Reference Symbol List | |
|---|---|
| 10b | second plate |
| 10c | third plate |
| 11 | feed shaft [manual paper feeder] |
| 12 | secondary channel |
| 13 | cutting mechanism |
| 14 | hinge axis |
| 15 | double arrow |
| 16 | stack of material in sheet form |
| 17 | top sheet (on item 16) |
| AV | file shredder |
| R | intake direction |
| L1 | inner section (on item 10) |
| L2 | outer section (on item 10) |

The invention claimed is:

1. A file shredder having an integrated unit for automatic feed of material in sheet form comprising:

(a) an upper device part comprising a cutting mechanism, at least one drive, and a control device;

(b) a feed shaft leading from a top of the upper device part;

(c) a secondary channel leading from a lateral chamber-shaped intake opening to the cutting mechanism, the chamber-shaped intake opening being adapted to receive a stack of sheets;

(d) a hinged lid pivotable about a pivot axis and associated with the chamber-shaped intake opening, said hinged lid having a face surface with a front lower edge;

(e) a lower device part supporting the upper device part; and (f) a barrier disposed near the front lower edge of the face surface of the hinged lid so that upon placing of a stack of sheets into the chamber-shaped intake opening, said barrier rests on a top sheet of the stack of sheets and removes any objects adhering to the top sheet when the top sheet is drawn in toward the cutting mechanism.

2. The file shredder according to claim 1, wherein the barrier comprises a first metal strip that is disposed in the region of the face surface of the hinged lid, on or in its underside.

3. The file shredder according to claim 2, wherein a first metal strip face surface is directed upward from a front edge of an underside of the first metal strip essentially at a right angle to the underside.

4. The file shredder according to claim 2, further comprising a second metal strip, wherein a second metal strip face surface is directed upward from a front edge of an underside of the second metal strip at an acute angle to the underside (71).

5. The file shredder according to claim 4, further comprising a third metal strip, wherein a front third metal strip face surface of the third metal strip is directed upward and is concave.

6. The file shredder according to claim 5, wherein the third metal strip is shaped in jagged manner at it's a front edge of the third metal strip and has multiple teeth disposed at a distance from one another.

7. The file shredder according to claim 4, wherein the second metal strip is shaped in jagged manner at said front edge and has multiple teeth disposed at a distance from one another.

8. The file shredder according to claim 7, wherein a free end of each tooth is rounded.

9. The file shredder according to claim 2, wherein the first metal strip is magnetic, at least in sections.

10. The file shredder according to claim 1, wherein at least one body is disposed in a front region of the hinged lid close to the face surface and far removed from the pivot axis as an additional weight.

11. The file shredder according to claim 10, wherein the at least one body is a metal piece disposed on the underside of the hinged lid.

12. The file shredder according to claim 10, wherein the at least one body is formed by multiple metal pieces attached at a distance from one another and disposed on the underside of the hinged lid.

13. The file shredder according to claim 1, wherein a force storage unit acts on the hinged lid in such a manner that the hinged lid causes the barrier to rest under pressure on the top sheet of the stack of sheets.

14. The file shredder according to claim 13, wherein the force storage unit comprises one or more springs that act on the hinged lid in such a manner that the hinged lid causes the barrier to rest under pressure on the top sheet of the stack of sheets.

* * * * *